US005818402A

United States Patent [19]

Park et al.

[11] Patent Number: 5,818,402

[45] Date of Patent: Oct. 6, 1998

[54] DISPLAY DRIVER FOR REDUCING CROSSTALK BY DETECTING CURRENT AT THE COMMON ELECTRODE AND APPLYING A COMPENSATION VOLTAGE TO THE COMMON ELECTRODE

[75] Inventors: Jong-Cheol Park; Yun-Cheol Jeong, both of Seoul, Rep. of Korea

[73] Assignee: LG Electronics Inc., Seoul, Rep. of Korea

[21] Appl. No.: 588,846

[22] Filed: Jan. 19, 1996

[51] Int. Cl.[6] ..... G09G 3/20; G09G 3/36

[52] U.S. Cl. ..... 345/58; 345/100

[58] Field of Search ..... 345/58, 94, 95, 345/98, 99, 100, 210, 214

[56] References Cited

U.S. PATENT DOCUMENTS

| | | | |
|---|---|---|---|
| 4,205,311 | 5/1980 | Kutaragi | 345/94 |
| 4,485,380 | 11/1984 | Soneda et al. | 345/58 |
| 4,873,516 | 10/1989 | Castleberry | 345/58 |
| 5,173,791 | 12/1992 | Strathman et al. | 345/92 |
| 5,283,477 | 2/1994 | Shibata | 345/98 |
| 5,414,441 | 5/1995 | Memarzadeh et al. | 345/101 |
| 5,430,460 | 7/1995 | Takabatake et al. | 345/96 |
| 5,436,819 | 7/1995 | Mikami et al. . | |
| 5,440,322 | 8/1995 | Prince et al. | 345/58 |
| 5,489,910 | 2/1996 | Kuwata et al. | 345/96 |
| 5,537,129 | 7/1996 | Okada et al. | 345/94 |
| 5,583,528 | 12/1996 | Ebihara | 345/58 |
| 5,589,847 | 12/1996 | Lewis | 345/98 |
| 5,592,191 | 1/1997 | Tsuboyama et al. | 345/94 |
| 5,598,178 | 1/1997 | Kawamori | 345/58 |
| 5,625,373 | 4/1997 | Johnson | 345/58 |
| 5,646,643 | 7/1997 | Hirai et al. | 345/58 |
| 5,670,973 | 9/1997 | Bassetti, Jr. et al. | 345/58 |
| 5,691,739 | 11/1997 | Kawamori et al. | 345/58 |
| 5,717,421 | 2/1998 | Katakurabet et al. | 345/98 |

*Primary Examiner*—Steven J. Saras
*Assistant Examiner*—Paul A. Bell
*Attorney, Agent, or Firm*—Finnegan, Henderson, Farabow, Garrett & Dunner, L.L.P.

[57] ABSTRACT

A common-voltage compensation driving apparatus and method and a crosstalk-compensation driving apparatus of an AMLCD detect current flowing through a common electrode for an optional period to compensate for a common electrode voltage by using the current value as a reference and eliminate crosstalk resulting from the variation of a video data value. The common-voltage compensation driving apparatus includes a current detector for detecting the current flowing through a common electrode for an optional period, a proportional voltage generator for integrating the current detected by the current detector to generate a proportional voltage corresponding to the integrated current, a common voltage generator for compensating the proportional voltage of the proportional voltage generator to a common electrode voltage during a compensating period shorter than one horizontal scanning period, and a controller for controlling driving times of the current detector, proportional voltage generator and common voltage generator. The method therefor is performed by a current detecting step, a proportional voltage generating step, and a common voltage generating step. The crosstalk compensation driving apparatus has the current detector, the proportional voltage generator, a data signal voltage compensator for compensating the proportional voltage of the proportional voltage generator to a data signal voltage output during a compensating period shorter than one horizontal scanning period, and the controller.

8 Claims, 8 Drawing Sheets

F.I G.1
prior art
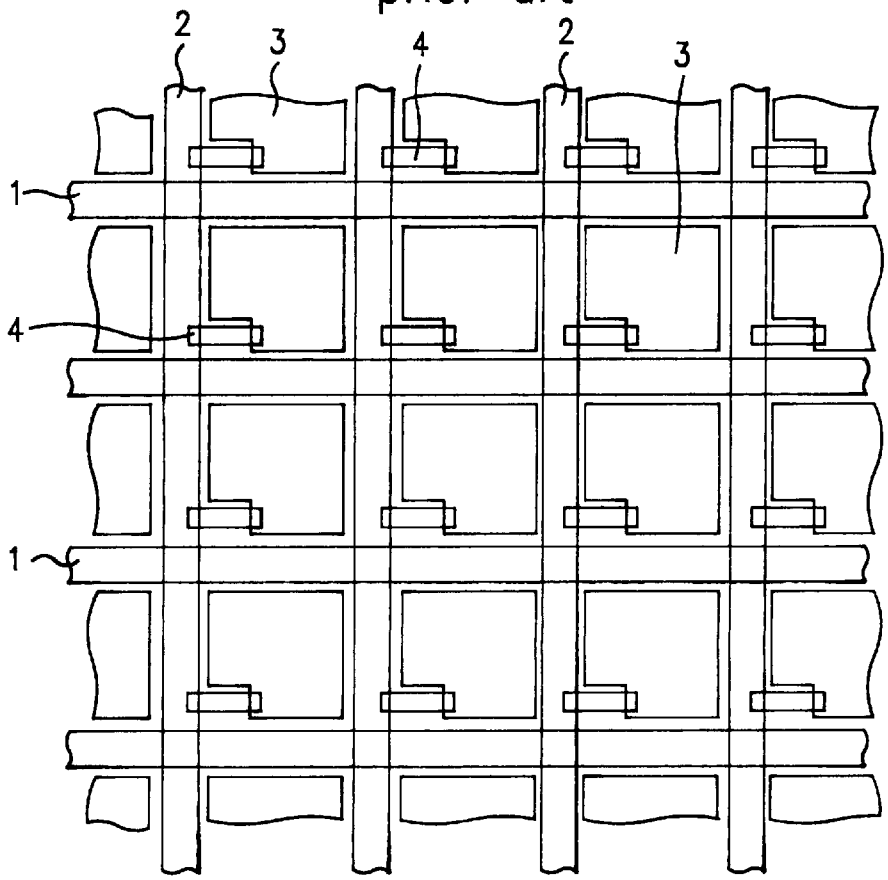
F.I G.2
prior art
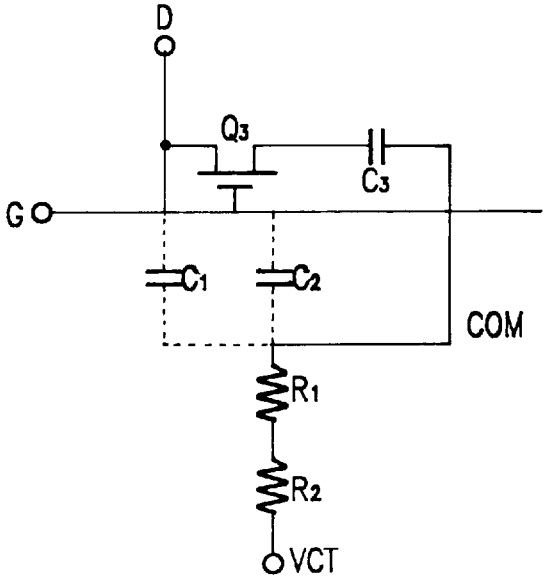

F.I G.3
prior art
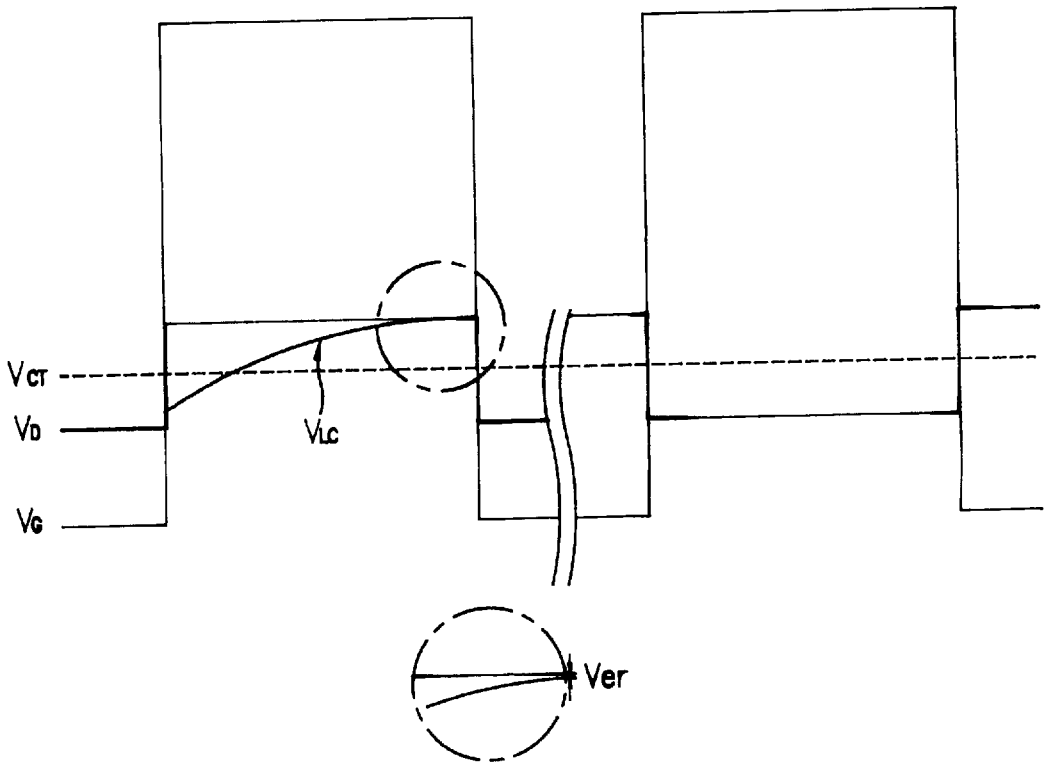
F.I G.4
prior art
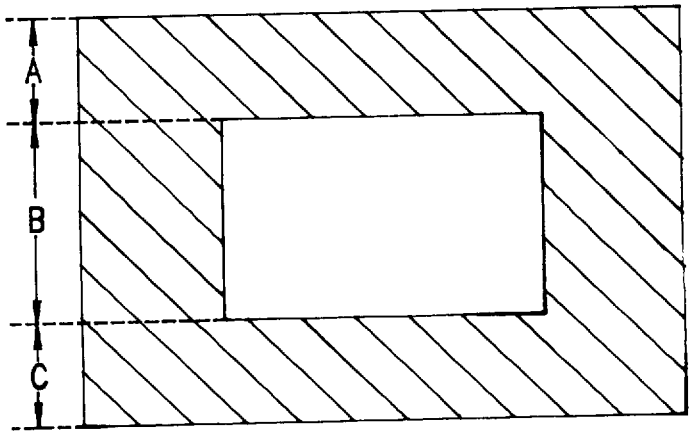

| mean video data voltage | | 5V | 6V | 7V |
|---|---|---|---|---|
| charged voltage of $C_3$ | before compensation | 5.561V | 5.473V | 5.385V |
| | after compensation | 5.521V | 5.521V | 5.521V |
| cross talk | before compensation | 0.176V | 0.080V | 0.0V |
| | after compensation | 0.0V | 0.0V | 0.0V |

DISPLAY DRIVER FOR REDUCING CROSSTALK BY DETECTING CURRENT AT THE COMMON ELECTRODE AND APPLYING A COMPENSATION VOLTAGE TO THE COMMON ELECTRODE

BACKGROUND OF THE INVENTION

1. Field of the Invention

The present invention relates to an active matrix liquid crystal display (hereinafter referred to as "AMLCD"), and more particularly to a common-voltage compensation driving apparatus and related method. In addition, the present invention is related to a crosstalk-compensation driving apparatus for an LCD which detects current flowing through a common electrode for a variable time period, and compensates a common electrode voltage in response to a reference current value, thereby eliminating crosstalk resulting from a variation for a video data value.

2. Description of the Prior Art

As shown in FIG. 1, a conventional AMLCD includes an array of pixels each having liquid crystal material (not shown) sandwiched between a common electrode provided on a top plate (not shown) and a pixel electrode 3 disposed on a bottom plate. The bottom plate further includes a plurality of gate lines 1 intersecting a plurality of data lines 2. Thin film transistors 4 serve as active devices located at intersecting portions of gate lines 1 and data lines 2. Gate lines 1 and data lines 2 serve as the gates and sources respectively of thin film transistors 4. In addition, pixel electrodes 3 is connected to respective drain electrodes of thin film transistors 4.

FIG. 2 shows an equivalent circuit of the AMLCD shown in FIG. 1, including a parasitic first capacitor $C_1$ connected between the data line D and upper-plate common electrode COM and a parasitic second capacitor $C_2$ provided between the gate line G and common electrode COM. Further, thin film transistor $Q_1$ is coupled to upper-plate common electrode COM via a liquid crystal capacitor $C_3$. In the circuit shown in FIG. 2, common resistor $R_1$ corresponds to the resistance of the upper plate, which is coupled to a connection resistor $R_2$ corresponding to the resistance associated with an external signal line connection to common electrode COM (i.e., a common voltage generating section VCT).

In driving the liquid crystal of the above-described liquid crystal display, a line inversion driving method, which is one kind of inversion driving method, is utilized in order to prevent deterioration of the liquid crystal material. In this driving method, the polarity of the video data of each horizontal line relative to the common electrode is alternately switched from positive to negative. FIG. 3 illustrates the line inversion driving method as it is used with the AMLCD shown in FIGS. 1 and 2. When a gate voltage $V_G$ goes high, the voltage across liquid crystal capacitor $C_3$, liquid crystal voltage $V_{LC}$, charges up to a given data line value $V_D$. At this time, an error voltage $V_{er}$ occurs when observing the end portion of liquid crystal voltage $V_{LC}$ as shown in the enlarged view in FIG. 3.

Further, in the conventional line inversion driving scheme discussed above, only one gate line is selected, while a total of N data lines are operated along the horizontal (gate) line, each one respectively receiving data line voltages $V_{Di}$ (where i=1,2,3, . . . and N). In this case, the effective data line capacitance is $C_1$ X N, and this capacitance affects the common electrode voltage while one of the data lines is driven. Specifically, the data line capacitance and the common electrode form a closed circuit with common resistor $R_1$. Thus, the current charging up the data line capacitance when a data line has a voltage $V_{Di}$ applied thereto produces a voltage at connection resistor $R_2$, thereby causing variations in the voltage charging up liquid crystal capacitor $C_3$. These variation can cause distortions in the resulting displayed image known as crosstalk.

Crosstalk is commonly observed as a darkening in portion B relative to portion A (see FIG. 4) of a display having an overall gray background and a white rectangular picture in the central portion of a normally white (i.e., having the characteristic of 100% light transmissivity of the liquid crystal if the voltage is not supplied to the liquid crystal) liquid crystal panel. Portion A is lighter than B due to the influence of the liquid crystal voltage of the white picture (which is lower than that of the black).

SUMMARY OF THE INVENTION

An object of the present invention is to provide an LCD display having reduced crosstalk. In particular, it is an object of the present invention to provide a common-voltage compensation driving apparatus and related method for crosstalk compensation.

In order to achieve these objects and in accordance with the present invention, an LCD crosstalk compensation driving apparatus is provided which includes a current detection circuit for detecting current flowing through a common electrode. The detected current is then used as a reference for adjusting the applied common electrode voltage to eliminate crosstalk caused by variations in the video data used to drive the LCD panel.

Further in accordance with the present invention, there is provided a common-voltage compensation driving apparatus of a liquid crystal display includes a current detecting section for detecting current flowing through a common electrode for an optional period. The current detected by the current detecting section is integrated by a proportional voltage generating section which then generates a proportional voltage corresponding to the integrated current. A common voltage generating section is also provided which compensates the proportional voltage of the proportional voltage generating section to a common electrode voltage during a compensating period shorter than one horizontal scanning period, and a controller controls driving times of the current detecting section, proportional voltage generating section and common voltage generating section.

Additionally, to achieve the above object of the present invention, a common-voltage compensation driving method of a liquid crystal display is performed by a current detecting step of detecting current flowing through a common electrode for an optional detecting period, and a proportional voltage generating step of integrating the current detected by the current detecting step and generating a proportional voltage corresponding to the integrated current. Finally, a common voltage generating step is carried out by compensating the proportional voltage in the proportional voltage generating step to a common electrode voltage during a compensating period shorter than one horizontal scanning period.

Moreover, a crosstalk compensation driving apparatus of a liquid crystal display includes a current detecting section for detecting current flowing through a common electrode for an optional period. The current detected by the current detecting section is integrated by a proportional voltage generating section which thus generates a proportional voltage corresponding to the integrated current. Especially, a data signal voltage compensating section compensates the proportional voltage of the proportional voltage generating section to a data signal voltage output during a compensating period shorter than one horizontal scanning period. A controller controls driving times of the current detecting section, proportional voltage generating section and data signal voltage compensating section.

BRIEF DESCRIPTION OF THE DRAWINGS

The above objects and other advantages of the present invention will become more apparent by describing in detail preferred embodiments thereof with reference to the attached drawings in which:

FIG. 1 is a plan view showing a lower plate of a conventional AMLCD panel;

FIG. 2 is an equivalent circuit diagram of one of the AMLCD pixels shown in FIG. 1;

FIG. 3 shows driving waveforms supplied to the equivalent circuit of FIG. 2;

FIG. 4 is a view of a conventional AMLCD display illustrating the effects of crosstalk;

DETAILED DESCRIPTION OF THE PREFERRED EMBODIMENTS

A preferred embodiment of a common-voltage compensation driving circuit and method of an AMLCD panel according to the present invention will be described with reference to the accompanying drawings.

Figure 5:
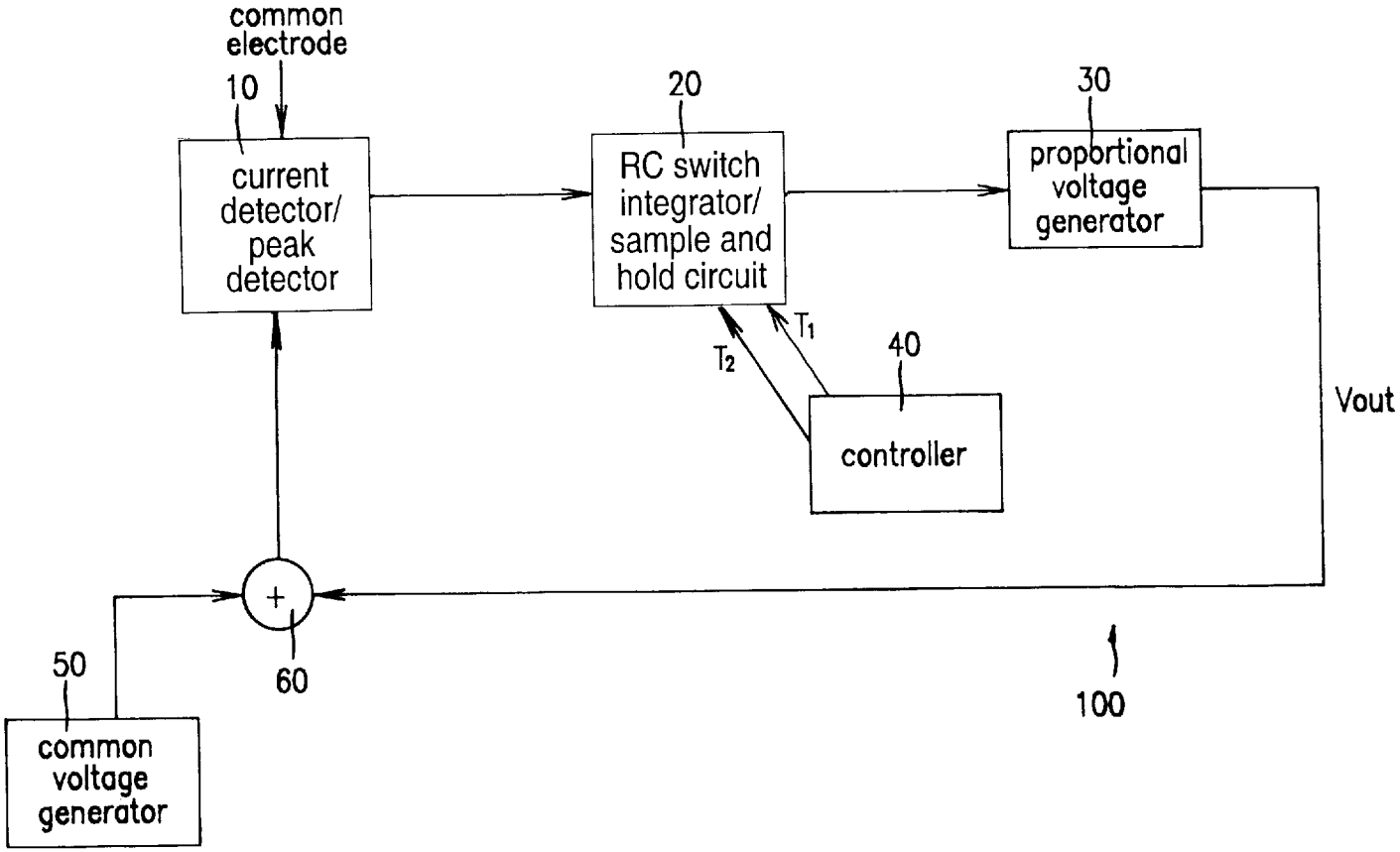
FIG. 5 is a block diagram showing one embodiment of a common-voltage compensation driving circuit of an AMLCD according to the present invention.

FIG. 5 is a block diagram showing a preferred embodiment of a common-voltage compensation driving circuit in accordance with the present invention. As illustrated in FIG. 5, the crosstalk compensating circuit 100 includes a current detecting section including a current detector 10 for detecting current which flows through a common voltage generating section of the LCD panel. Preferably, a proportional voltage generating section is also provided which includes an RC switched integrator circuit 20, which receives an output corresponding to current detected in detector 10. Integrator circuit 20 integrates detected current values for certain period T1. A proportional voltage generator 30 is also included for setting a reference voltage in proportion to the output of integrator 20. The reference voltage is then supplied to adder 60 which adds it to the output of a common voltage generator 50. The sum of these two voltages is a compensated common electrode voltage which offsets variations in the voltage charging up liquid crystal capacitor $C_3$.

The common electrode voltage is compensated for less for a period shorter than one horizontal scanning period. Also, a controller 40 (preferably including appropriate multivibrator and RC circuitry) regulates the integration and compensating time of current detector 10 so that proportional voltage generator 30 and common voltage generator 50 allow the driving time to match the overall operation of the LCD panel.

Alternatively, current detector 10 and integrating circuit 20 of the compensation driving apparatus shown in FIG. 5 may be substituted by a peak detector and a sample-and-hold circuit 10 for detecting the current in the common electrode and compensating the common voltage in accordance with the detected current.

Here, a crosstalk compensation driving circuit of the LCD is attained by installing a data signal voltage compensator into the structure of FIG. 5, so that common voltage generator 50 compensates the proportional voltage of adder 60 to a data signal output for the compensating period shorter than the horizontal scanning period.

Figure 9A:
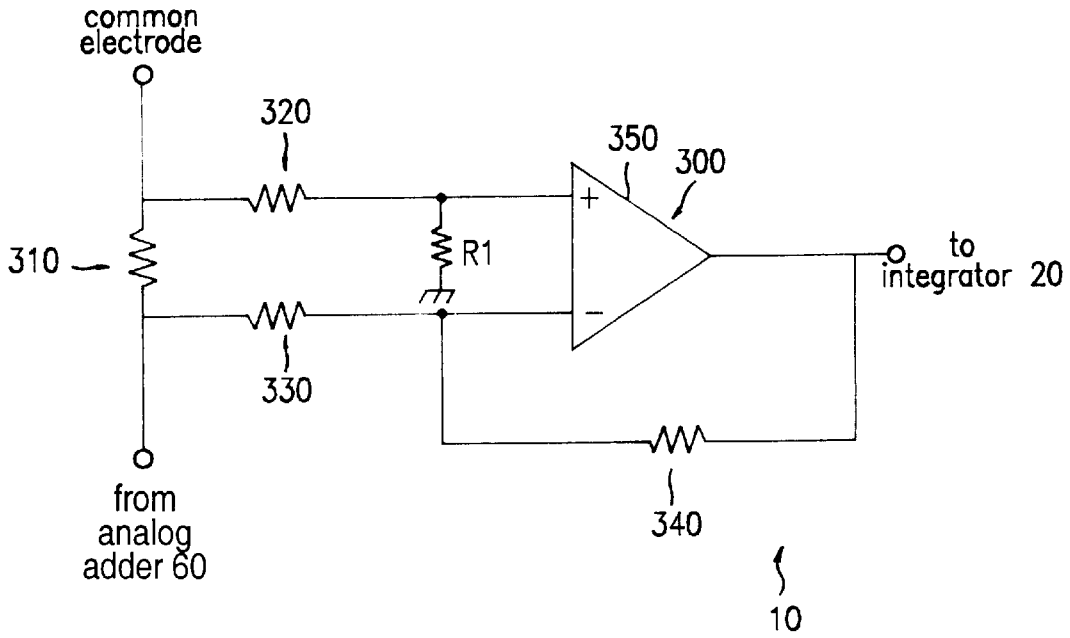
FIG. 9A is a schematic diagram of current detector 10 in accordance with the present invention.
Figure 9B:
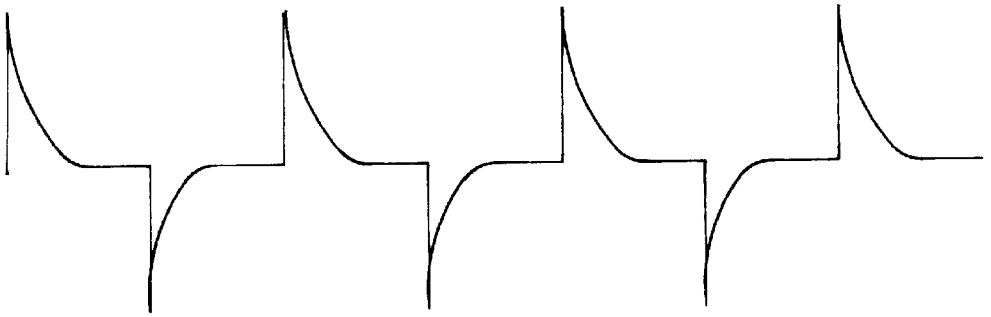
FIG. 9B illustrates an output waveform of current detector 10 in accordance with the present invention.

FIG. 9A illustrates current detector 10 in greater detail. Current detector 10 preferably includes a differential amplifier 300 having an opamp 350 whose noninverting and inverting inputs are connected across a sampling or pilot resistor 310. The inverting input is connected to the output of analog adder 50 while the noninverting input is coupled to the common electrode. Resistors 320, 330 and 340 are connected as shown in FIG. 9A and have values such that an appropriate waveform is generated at the output of opamp 350. Differential amplifier 300 measures the algebraic difference of the voltage across resistor 310. The output of the differential amplifier has a generalized waveform including a series of positive and negative spikes as shown in FIG. 9B.

Since the liquid crystal panel is driven one line at a time, current detector 10 detects the current for a certain time T1 (generated by controller 40) at a point that video data is supplied to the panel during one horizontal scanning period 1H (i.e., one line driving period.)

Figure 10:
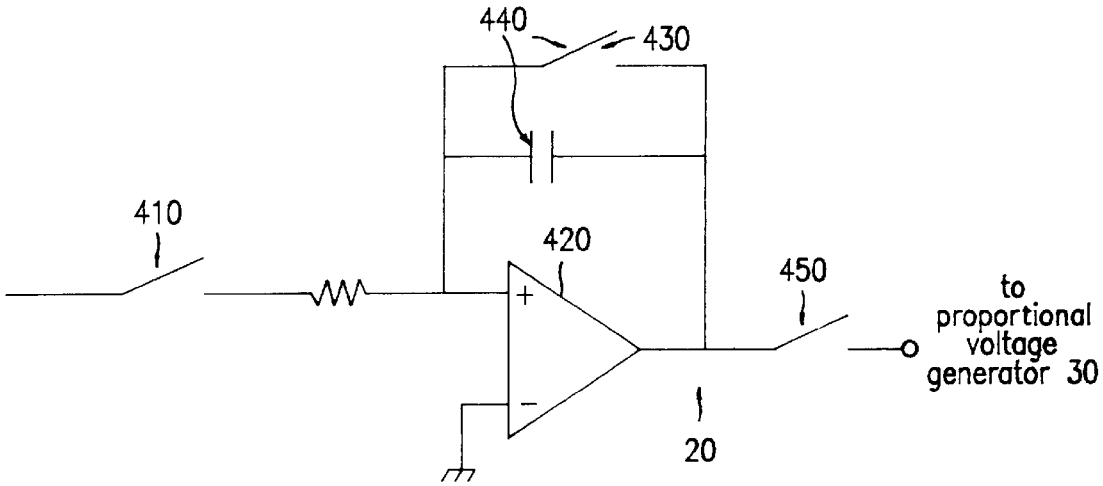
FIG. 10 is a schematic diagram of integrator 20.

The output of current detector 10 is supplied to integrator 20, which is illustrated in detail in FIG. 10. Integrator 20 includes a first switch 410 coupled to the noninverting input of opamp 420. A second switch 430 is provided in parallel with capacitor 440 across the noninverting input and the output of opamp 420. A third switch 450 is provided at the output of opamp 420.

Figure 11A:
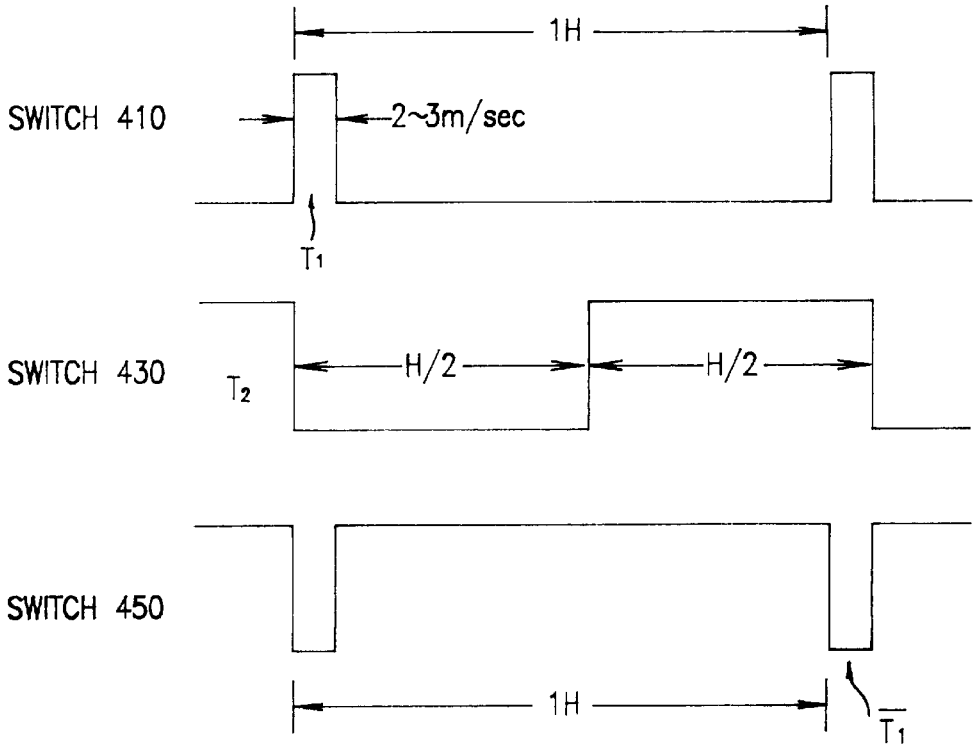
FIG. 11A illustrates timing diagrams of pulses used to open and close switches 410, 430 and 450 shown in FIG. 10.

The timing diagrams of pulses used to open and close switches 410, 430 and 450 are illustrated in FIG. 11A. Specifically, switch 410 is closed for each of pulses T1 (generated by controller 40) having a duration of approximately 2–3 microseconds and spaced apart by a 64 microsecond horizontal sync period (1H). Switch 430 is preferably closed for each of pulses T2, which have a width equal to one half 1H. As further shown in FIG. 10, each pulse T2 (generated by controller 40) appears in the second half of 1H. Further, switch 450 receives the inverse of pulses T1, and therefore remains closed for much of 1H.

Figure 11B:
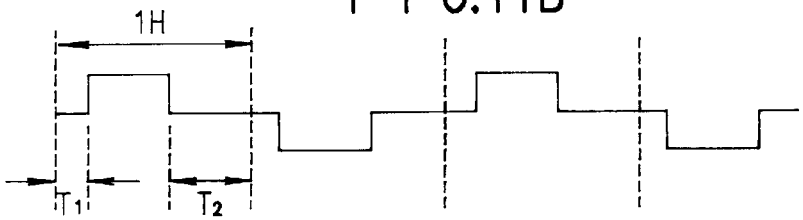
FIG. 11B illustrates a generalized waveform corresponding to the output of integrator 20.

Integrator 20 shown in FIG. 10 is an RC switched integrator, which has a controlled integration time only during pulse T2. In addition, this circuit integrates over half of a 1H over the first 2–3 microseconds on each 1H, which includes the spikes shown in the waveform in FIG. 9A. Further, both switches 430 and 450 are open while switch 410 is closed, to charge up capacitor 440 to insure proper operation of integrator 20. A generalized waveform corresponding to the output of integrator 20 is illustrated in FIG. 11B.

Figure 12:
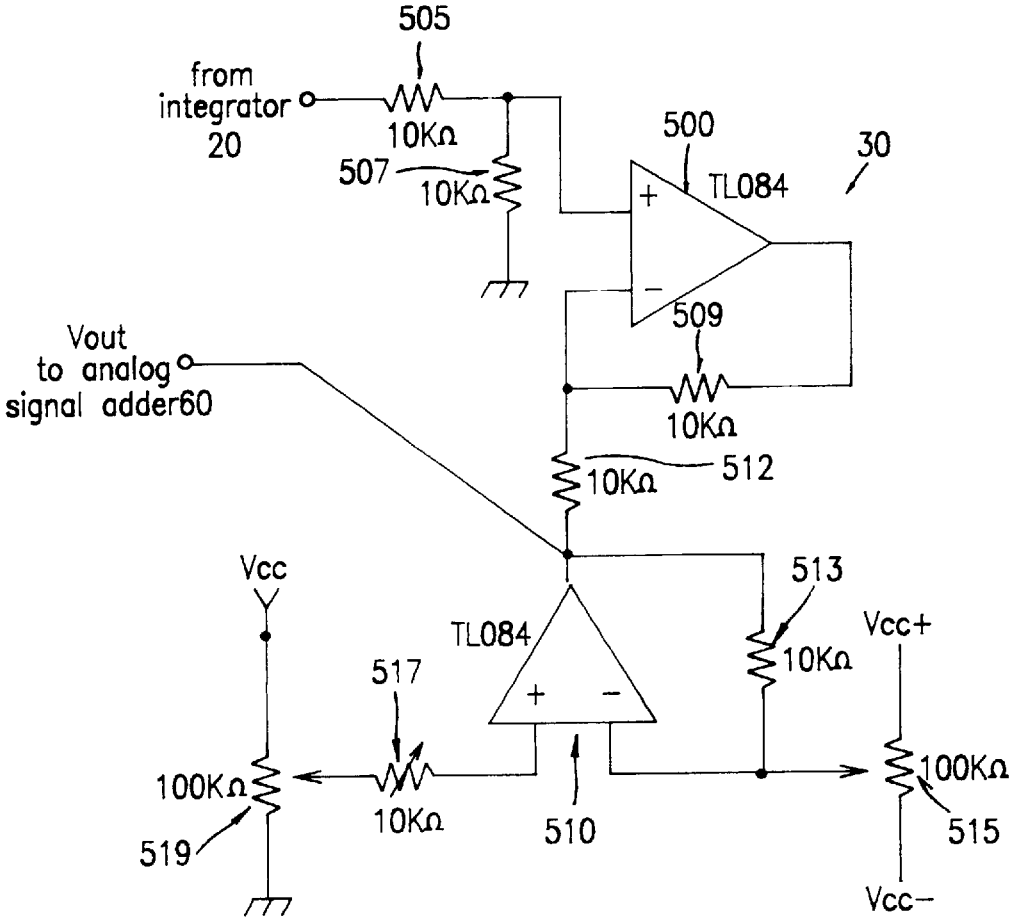
FIG. 12 is a schematic diagram of proportional voltage generator 30.

The output of integrator 20 is supplied to proportional voltage generator 30, which is shown in detail in FIG. 12. Proportional voltage generator 30 include first and second differential amplifiers 500 and 510 having resistors 505, 507 509 512, 513, 515, 517 and 519 appropriately connected as shown in FIG. 12. Resistor 517 is also a variable resistor but its maximum resistance is 10 kohm.

Resistors 515 and 519 are preferably 100 kohm adjustable transistors, which can have its resistance changed manually. Resistor 515 is connected between $+V_{CC}$ and $-V_{CC}$ and provides a controllable offset voltage. Resistor 519 is connected between ground and the common voltage generator output, the value of which varies during each sample of integrator 20.

The output of compensation circuit 30, $V_{OUT}$, is essentially the output of integrator 20, but level-shifted. $V_{OUT}$ is proportional to the liquid crystal current alone and is obtained by eliminating the common voltage component of the integrator output by supplying a minimum threshold voltage to proportional voltage generator 30 when the liquid crystal is in the normally white state.

Figure 13:
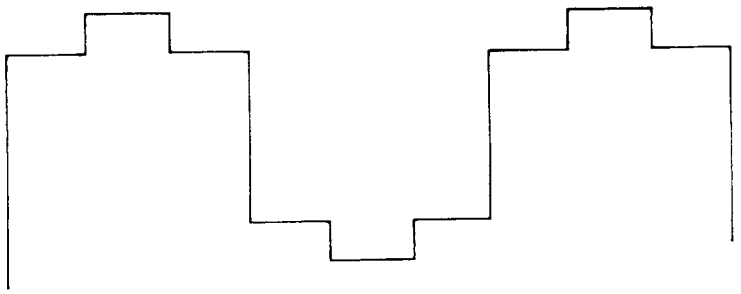
FIG. 13 illustrates an output waveform of analog signal adder 60.

$V_{OUT}$ is supplied to analog signal adder 60, where it is summed with the output of common voltage generator 50. The summed output has a generalized waveform depicted in FIG. 13.

The output of adder 60 is then supplied to the common electrode via current detector 10, to thereby establish a feedback a feedback loop.

The operation and method of the common-voltage compensation driving circuit and an operation of the crosstalk-compensation driving circuit of the AMLCD according to the present invention will now be further described with reference to FIGS. 6 and 7.

Figure 6A:
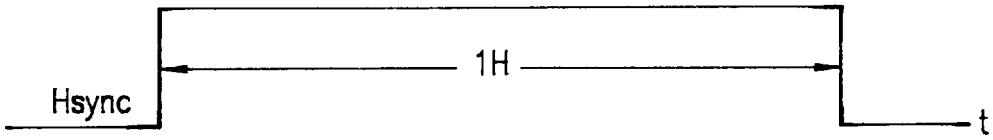
FIGS. 6A–6D show operational waveforms of switch control signals generated in the common-voltage compensation driving circuit in accordance with the present invention.
Figure 6B:
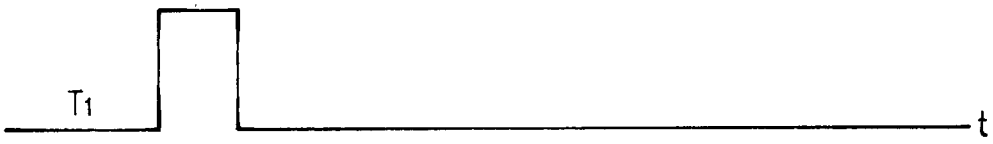
Figure 6C:
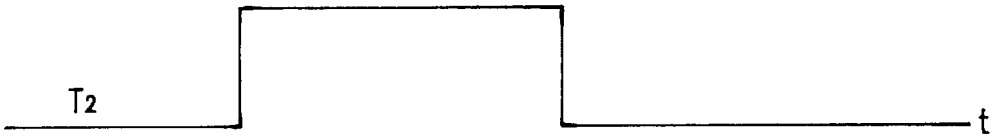
Figure 6D:
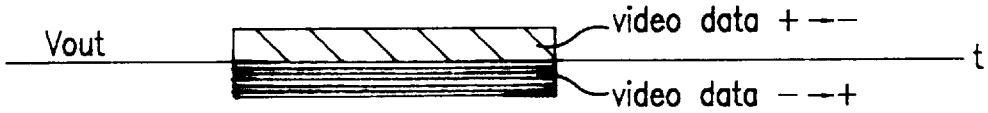

FIGS. 6A and 6D show operational waveforms Hsync (i.e., 1H), T1, T2 and $V_{OUT}$ generated by the common-voltage compensation driving circuit according to the present invention and how these signals appear in time relative to each other.

Further, with respect to FIG. 6D, a common-voltage compensation voltage $V_{OUT}$ is output from integrating circuit 20 and proportional voltage generator 30, and a negative crosstalk voltage occurs across common resistor $R_1$ and connection resistor $R_2$, if the currently scanning voltage is higher than the charging voltage of a previous data line. Therefore, a negative polarity common-voltage compensation voltage $V_{OUT}$ as shown in FIG. 6D is added to the input of the common voltage generating section.

However, if the data voltage of a driven line is lower than the previous data voltage charging up the data line, common voltage VCT of FIG. 2 has a positive polarity, so that common voltage compensation voltage $V_{OUT}$ having a positive polarity as shown in FIG. 6D is added to the common voltage generator output.

By detecting the common electrode current as described above, the influence of the common electrode voltage, other connection resistances, etc. of FIG. 2 can also be compensated for a specific time period during a one-line driving interval. Crosstalk appearing in the liquid crystal panel is thus eliminated.

Figures 7, 8:
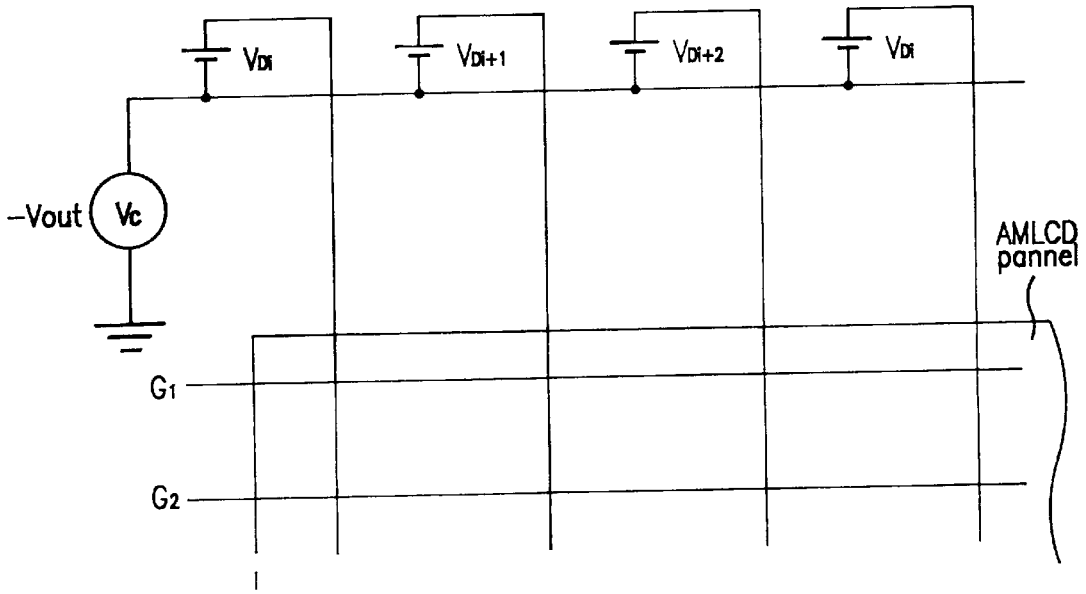
FIG. 7 is a reference table representing the charging characteristic and crosstalk corresponding to different mean video signals in the present invention.
FIG. 8 illustrates variations in the data-line driving output voltage by means of a current value generated from the common resistor in accordance with the present invention.

As one example of the above-described driving method, FIG. 7 lists the charged voltage of capacitor $C_3$ and crosstalk voltage for both compensated and uncompensated common electrode voltages at three different mean video data voltages. The data in table 7 was determined based on the following parameters: 1H=63 microseconds, T1=3 microseconds and T2=30 microseconds in FIG. 6; and $C_1XW$=80 nF, $R_1+R_2$=300 ohm, and $C_3$=0.3 pF in FIG. 2. The resulting data values correspond to a single line of the LCD array and show 0 volts of crosstalk after compensation has been performed.

Crosstalk can also be eliminated by adding the common-voltage compensation voltage $V_{OUT}$ as an offset-bias to a video data driver output signal during interval T2 of FIG. 6. For example, as shown in FIG. 8, the common-voltage compensation voltage $V_{OUT}$ can be supplied to a common line 200 that provides video data to the AMLCD panel. The circuit shown in FIG. 8 can achieve the same level of crosstalk reduction as the circuit in FIG. 5.

The operation of the circuit shown in FIG. 8 will now be described. If data line D has a positive polarity while common voltage generating VCT has a negative polarity, the component of common-voltage compensation voltage $V_{OUT}$ becomes negative. Therefore, when compensation is performed at the common voltage generating section VCT, the common electrode voltage, in this case negative $V_{OUT}$, is supplied to the data lines D. Positive $V_{OUT}$, however, can also be supplied to data line D.

In a common-voltage compensation driving circuit and method of an AMLCD according to the present invention as described above, current flowing through a common electrode is detected in order to compensate a common electrode voltage using the current value as a reference, thereby easily eliminating the crosstalk resulting from variations in the video data.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A common-voltage compensation driving apparatus of a liquid crystal display comprising:

current detecting means for detecting current flowing through a common electrode for a predetermined period;

proportional voltage generating means for integrating the current detected by said current detecting means, and generating a proportional voltage corresponding to the integrated current;

common voltage generating means for adjusting said proportional voltage of said proportional voltage generating means to a common electrode voltage during a compensating period shorter than one horizontal scanning period; and a controller for controlling driving times of said current detecting means, said proportional voltage generating means and said common voltage generating means.

2. A common-voltage compensation driving apparatus for a liquid crystal display in accordance with claim 1, wherein said proportional voltage generating means comprises:

an integrating circuit part for integrating said current detected by said current detecting means; and a proportional voltage generating part for generating said proportional voltage corresponding to the current integrated by said integrating circuit part.

3. A common-voltage compensation driving apparatus for a liquid crystal display in accordance with claim 1, wherein said proportional voltage generating means comprises:

a sample and hold circuit for sampling and holding said current detected by said current detecting means; and a proportional voltage generating part for generating said proportional voltage corresponding to the sampled and held current.

4. A common-voltage compensation driving method of a liquid crystal display comprising:

detecting a current flowing through a common electrode for a predetermined detecting period;

integrating the current detected by said current detecting step and generating a proportional voltage corresponding to the integrated current; and adjusting said proportional voltage to a common electrode voltage during a compensating period shorter than one horizontal scanning period.

5. A crosstalk compensation driving apparatus of a liquid crystal display comprising:

current detecting means for detecting current flowing through a common electrode for an optional period;

proportional voltage generating means for integrating the current detected by said current detecting means, and generating a proportional voltage corresponding to the integrated current;

data signal voltage compensating means for compensating said proportional voltage of said proportional voltage generating means to a data signal voltage output during a compensating period shorter than one horizontal scanning period; and a controller for controlling driving times of said current detecting means, proportional voltage generating means and data signal voltage compensating means.

6. A liquid crystal display device comprising:

a first substrate having a plurality of data lines and gate lines arranged in a matrix;

a second substrate having a common electrode disposed thereon;

a current detector circuit sensing a current flowing through said common electrode;

a compensating voltage circuit generating a compensating voltage in response to said sense current;

a common voltage generating circuit supplying first common electrode voltage;

an adder circuit adding said compensating voltage to said first common electrode voltage to generate a second common electrode voltage to be supplied to said common electrode.

7. A liquid crystal display device in accordance with claim 6, wherein said second common electrode voltage is supplied to said common electrode via said current detector circuit to thereby provide a feedback path through said compensating voltage circuit and said adder circuit.

8. A drive circuit for compensating coupling distortions in a voltage of a common electrode in a liquid crystal display, said drive circuit comprising:

a current detector connected to the common electrode and adapted to sense a current flowing through the common electrode;

an integrator for integrating the current detected by said current detector; and a compensation circuit for compensating said voltage of said common electrode based on said integrated current detected by the current detector.

* * * * *